US008971762B2

(12) United States Patent
Fukase

(10) Patent No.: US 8,971,762 B2
(45) Date of Patent: Mar. 3, 2015

(54) IMAGE FORMING APPARATUS

(71) Applicant: Canon Kabushiki Kaisha, Tokyo (JP)

(72) Inventor: Yasuhiro Fukase, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 13/856,024

(22) Filed: Apr. 3, 2013

(65) Prior Publication Data

US 2013/0272745 A1 Oct. 17, 2013

(30) Foreign Application Priority Data

Apr. 13, 2012 (JP) ..... 2012-091700

(51) Int. Cl.

| | |
|---|---|
| ***G03G 15/00*** | (2006.01) |
| ***G03G 21/00*** | (2006.01) |
| ***G03G 15/16*** | (2006.01) |
| ***G03G 21/16*** | (2006.01) |

(52) U.S. Cl.

CPC ..... *G03G 15/16* (2013.01); *G03G 21/1647* (2013.01); *G03G 21/168* (2013.01); *G03G 21/1633* (2013.01)

USPC ..... 399/121; 399/124; 399/125

(58) Field of Classification Search

USPC ..... 399/121, 124, 125

See application file for complete search history.

(56) References Cited

U.S. PATENT DOCUMENTS

| | | | | |
|---|---|---|---|---|
| 7,391,993 | B2 * | 6/2008 | Ito | 399/124 |
| 7,933,538 | B2 | 4/2011 | Aoki et al. | |
| 8,027,618 | B2 | 9/2011 | Aoki et al. | |
| 8,155,546 | B2 | 4/2012 | Fukase | |
| 8,467,704 | B2 * | 6/2013 | Sato et al. | 399/121 |
| 8,521,063 | B2 * | 8/2013 | Saito et al. | 399/121 |

FOREIGN PATENT DOCUMENTS

| | | |
|---|---|---|
| JP | 2000-47444 A | 2/2000 |
| JP | 2010-286658 A | 12/2010 |

OTHER PUBLICATIONS

Machine translation of JP 2010-286658 dated Aug. 27, 2014.*

* cited by examiner

*Primary Examiner* — Sophia S Chen

(74) *Attorney, Agent, or Firm* — Fitzpatrick, Cella, Harper & Scinto

(57) ABSTRACT

An image forming apparatus includes a bearing member provided to a secondary transfer unit, with the bearing member being configured to engage with a main body unit of the apparatus, a hooking-receiving member rotatably provided in the main body unit of the apparatus and opposed to the bearing member, and a rotation regulation member provided to the main body unit of the apparatus to regulate rotation of the hooking-receiving member. The hooking-receiving member contacts the rotation regulation member when the secondary transfer unit is closed with respect to the main body unit of the apparatus and-rotates in a direction away from the rotation regulation member when the secondary transfer unit is opened with respect to the main body unit of the apparatus.

10 Claims, 8 Drawing Sheets

$$L3 \times F3 \geqq L4 \times F4$$

IMAGE FORMING APPARATUS

BACKGROUND OF THE INVENTION

1. Field of the Invention

The present invention relates to an image forming apparatus of the electrophotographic type or electrostatic recording type, such as a copy machine, a multifunction printer and a laser beam printer, for example.

2. Description of the Related Art

The color-image forming apparatus of the electrophotographic type can be further divided into two types: one transfers a toner image directly from an image bearing member to a recording material; and the other transfers a toner image from an image bearing member to an intermediate transfer member in a primary transfer process, and then transfers the toner image from the intermediate transfer member to a recording material in a secondary transfer process.

The color-image forming apparatus of the type of transferring a toner image directly from an image bearing member to a recording material often uses an electrostatic adsorption belt for conveying the recording material, while the color-image forming apparatus of the type of transferring a toner image from an intermediate transfer member to a recording material in the secondary transfer process often uses an intermediate transfer belt.

In general, for the secondary transfer process to transfer a toner image to a recording material, the color-image forming apparatus has a configuration in which, by means of a secondary transfer roller, the recording material is conveyed while the secondary transfer process is being performed with the recording material being held between a secondary transfer opposing roller of the intermediate transfer member and the secondary transfer roller.

Some secondary transfer rollers have a configuration in which a secondary transfer unit that integrally unitizes conveying paths before and after the secondary transfer process together is spaced apart from the intermediate transfer member, thereby enabling the secondary transfer unit to be opened and closed for the clearance of jams of the recording material such as a sheet of paper, the easy replacement of the intermediate transfer member or the unit including the intermediate transfer member and the like.

The secondary transfer roller is required to be capable of applying high pressure on the intermediate transfer member and the secondary transfer opposing roller to achieve a good image quality and to prevent the slip of the recording material during its conveyance in the secondary transfer process.

In addition, for locking (securing) or holding the secondary transfer unit, some color-image forming apparatuses have a configuration in which one or more locking portions are respectively provided on both end sides of the secondary transfer unit outside the recording material conveying area. In some cases, not all the locking portions can be fully locked due to reaction force in response to the high pressure of the secondary transfer roller.

In order to avoid this, some color-image forming apparatuses have a configuration in which detection sensors are respectively provided on all the locking portions, and when incomplete locking of the locking portions is detected, a user is prompted to lock the locking portions again.

As in Japanese Patent Application Laid-Open No. 2010-286658, some color-image forming apparatuses have a configuration in which rolling members of locking portions are locked in synchronization with an openable and closable member with the help of separate leading guides.

However, the above prior techniques have the following problems.

It is expensive to provide detection sensors to all the locking portions for detecting incomplete locking of the locking portions and prompting a user to lock the locking portions again. Additionally, this approach is not desirable in terms of usability, because it requires excessive open-close operation by the user.

For the configuration as shown in Japanese Patent Application Laid-Open No. 2010-286658 in which rolling members of locking portions are locked in synchronization with an openable and closable member with the help of separate leading guides, it is difficult to save space because large space is needed for the movement of the leading guides.

SUMMARY OF THE INVENTION

In these contexts, a purpose of the present invention is to provide an image forming apparatus for reducing incomplete locking of an openable and closable transfer unit.

Another purpose of the present invention is to provide an image forming apparatus including an image bearing member, on a surface of which a toner image is formed, a main body unit configured to support the image bearing member, a transfer unit provided so as to be openable and closable with respect to the main body unit, the transfer unit being configured to hold a recording material between the transfer unit and the image bearing member and transfer a toner image formed on the image bearing member to the recording material, a first engagement portion provided to the transfer unit, the first engagement portion being configured to engage with the main body unit, an opposing member movable and opposed to the first engagement portion, and a regulation member provided to the main body unit, the regulation member being configured to regulate movement of the opposing member, wherein the opposing member contacts the regulation member when the transfer unit is closed with respect to the main body unit, and the opposing member moves away from the regulation member when the transfer unit is opened with respect to the main body unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
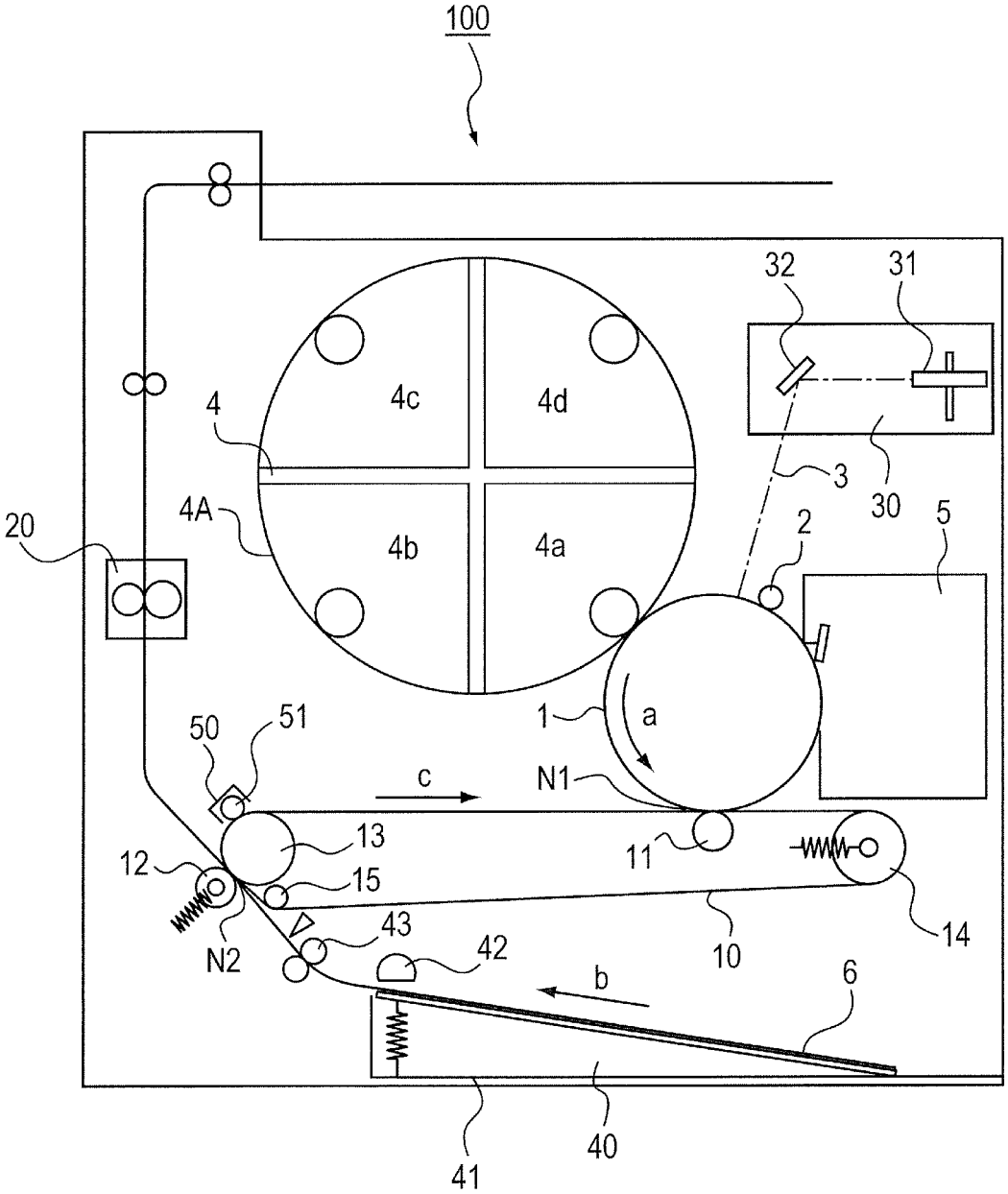
FIG. 1 is an illustrative cross-sectional view describing a configuration of an image forming apparatus according to the present invention.

FIG. 1 is an illustrative cross-sectional view describing a schematic configuration of an image forming apparatus 100 according to the present invention. In particular, the image forming apparatus 100 shown in FIG. 1 is a four-color laser beam printer of the electrophotographic type and uses an intermediate transfer belt 10 as an image bearing member on the surface of which a toner image is formed.

The image forming apparatus 100 shown in FIG. 1 includes a drum type electrophotographic photoconductor (hereinafter referred to as "photoconductive drum") 1 as an image bearing member. The photoconductive drum 1 is rotatably supported by the image forming apparatus 100 and driven by a driving unit not shown in the drawings to rotate in the direction of the arrow "a".

A charging roller 2 of the contact type for uniformly charging the surface of the photoconductive drum 1, and an exposure unit 30 for emitting laser light 3 on the surface of the photoconductive drum 1 according to image information to form an electrostatic latent image are provided along the rotation direction around the photoconductive drum 1. A developing unit 4 for transferring toner onto the electrostatic latent image to develop the electrostatic latent image as a toner image, and an intermediate transfer belt 10 to which the toner image on the surface of the photoconductive drum 1 is transferred in the primary transfer process are also provided. In addition, a cleaning unit 5 for removing toner left on the surface of the photoconductive drum 1 after the primary transfer process is provided.

A primary transfer roller 11 arranged inside the intermediate transfer belt 10 presses the intermediate transfer belt 10 against the surface of the photoconductive drum 1 to form a primary transfer nip portion N1 between the photoconductive drum 1 and the intermediate transfer belt 10. A primary transfer bias is applied to the primary transfer roller 11 by a power source not shown in the drawings.

A secondary transfer roller 12 arranged outside the intermediate transfer belt 10 forms a secondary transfer nip portion N2 between the intermediate transfer belt 10 and the secondary transfer roller 12. A secondary transfer bias voltage is applied to the secondary transfer roller 12 by a power source not shown in the drawings. Moreover, a roller charger 51 of the electrostatic type for cleaning the intermediate transfer belt 10 is arranged so as to face the intermediate transfer belt 10.

A fixing unit 20 for heating and pressing the toner image transferred to a recording material 6 to fix the toner image to the recording material 6 is arranged on the downstream side of the secondary transfer nip portion N2 in the conveying direction of the recording material 6 as shown by the arrow "b" in FIG. 1.

The photoconductive drum 1 is made by providing a photoconductive layer such as an Organic Photoconductor (OPC) on the outer surface of an aluminum cylinder.

The charging roller 2 includes a metal core and a conductive elastic member surrounding the metal core and is arranged in contact with the surface of the photoconductive drum 1 and rotated, and a charging bias is applied to the charging roller 2 by a power source not shown in the drawings.

The exposure unit 30 includes a laser oscillator, which is not shown in the drawings, for emitting the laser light 3 according to the image information, a polygon mirror 31 and a mirror 32, and exposes the surface of the photoconductive drum 1 to form an electrostatic latent image according to the image information.

The developing unit 4 includes a rotating body 4A and four color developing devices 4*a*-4*d* mounted on the rotating body 4A, i.e., a yellow developing device 4*a*, magenta developing device 4*b*, cyan developing device 4*c*, and black developing device 4*d*. The rotating body 4A is rotated by a driving unit not shown in the drawings. Thus, the developing unit 4 (the yellow developing device 4*a* in the case of FIG. 1) is placed in a position for development where the developing unit 4 faces the surface of the photoconductive drum 1 so that the developing unit 4 can be used to develop the electrostatic latent image on the surface of the photoconductive drum 1. In the four-color full-color image forming, the developing devices 4*a*-4*d* are placed in turns in the position for development.

The intermediate transfer belt 10 is formed as an endless belt and stretched between a driving roller 13 and tension rollers 14, 15, which serve as three supporting roller arranged parallel to each other. The intermediate transfer belt 10 is conveyed in the direction of the arrow "c" in FIG. 1 by the driving roller 13 rotated by a driving unit not shown in the drawings. The tension rollers 14, 15 are rotated by the intermediate transfer belt 10.

The primary transfer roller 11 is arranged in a position opposite the photoconductive drum 1 and on the inner surface side of the intermediate transfer belt 10, and presses the intermediate transfer belt 10 against the surface of the photoconductive drum 1 to form the primary transfer nip portion N1.

The secondary transfer roller 12 is arranged in a position opposite the driving roller 13 and on the outer surface side of the intermediate transfer belt 10, and the secondary transfer nip portion N2 is formed between this secondary transfer roller 12 and the surface of the intermediate transfer belt 10. In addition, the cleaning unit 50 of the electrostatic type is arranged so as to face the surface of the intermediate transfer belt 10 on the downstream side of the secondary transfer nip portion N2 in the conveying direction of the intermediate transfer belt and on the upstream side of the primary transfer nip portion N1 in the conveying direction of the intermediate transfer belt 10. The cleaning unit 50 includes the roller charger 51 arranged on the surface of the intermediate transfer belt 10 and a DC power source, which is not shown in the drawings, connected to the roller charger 51.

A feeder 40 feeds the recording material 6 to an image forming portion, and comprises a recording material cassette 41 which holds multiple sheets of the recording material 6, a feed roller 42 and a registration roller 43.

The operation of the above-mentioned image forming apparatus 100 will be described below.

The surface of the photoconductive drum 1 driven to rotate in the direction of the arrow "a" in FIG. 1 is uniformly charged by applying to the charging roller 2 a charging bias which is a combination of DC voltage and AC voltage.

When a yellow image signal is input to the laser oscillator not shown in the drawings, the laser light 3 is emitted onto the charged surface of the photoconductive drum 1 to form an electrostatic latent image. After that, when the photoconductive drum 1 rotates in the direction of the arrow "a" in FIG. 1, the yellow developing device 4*a* transfers yellow toner onto the electrostatic latent image on the surface of the photoconductive drum 1 to develop the electrostatic latent image as a toner image.

In the primary transfer process, the yellow toner image on the surface of the photoconductive drum 1 is transferred to the intermediate transfer belt 10 via the primary transfer nip portion N1 due to the primary transfer bias applied to the primary transfer roller 11. Once the toner image is transferred, toner left on the surface of the photoconductive drum 1 after the primary transfer process is removed by the cleaning unit 5 so that the photoconductive drum 1 can be used for the next image forming.

The above sequence of image forming processes: charging, exposure, development, primary transfer and cleaning are repeated for the other three colors, i.e., magenta, cyan and black to form a four-color toner image on the intermediate transfer belt 10.

In the secondary transfer process, the four-color toner image on the intermediate transfer belt 10 is transferred to the recording material 6, which is conveyed in the direction of the arrow "b" in FIG. 1, via the secondary transfer nip portion N2 by way of the secondary transfer bias voltage which is applied to the secondary transfer roller 12 by a power source.

After the transfer of the toner image via the secondary transfer nip portion N2, the recording material 6 is conveyed to the fixing unit 20, which in turn heats and presses the recording material 6 to fix the toner image to the recording material 6, thereby providing a four-color full-color image on the recording material 6.

Meanwhile, after the transfer of the toner image, some toner which was not transferred to the recording material 6 in the secondary transfer process is left on the intermediate transfer belt 10. The toner left on the intermediate transfer belt 10 after the secondary transfer process is collected by the cleaning unit 5 via the photoconductive drum 1 by way of the function of the cleaning unit 50.

In particular, the toner left after the secondary transfer process is given the opposite polarity, i.e., positive charges, by the cleaning unit 50 and thus transferred in the reverse direction to the surface of the photoconductive drum 1 via the primary transfer nip portion N1. The toner left after the secondary transfer process and transferred in the reverse direction is removed by the cleaning unit 5 together with the toner left on the surface of the photoconductive drum 1 after the primary transfer process.

Figure 2:
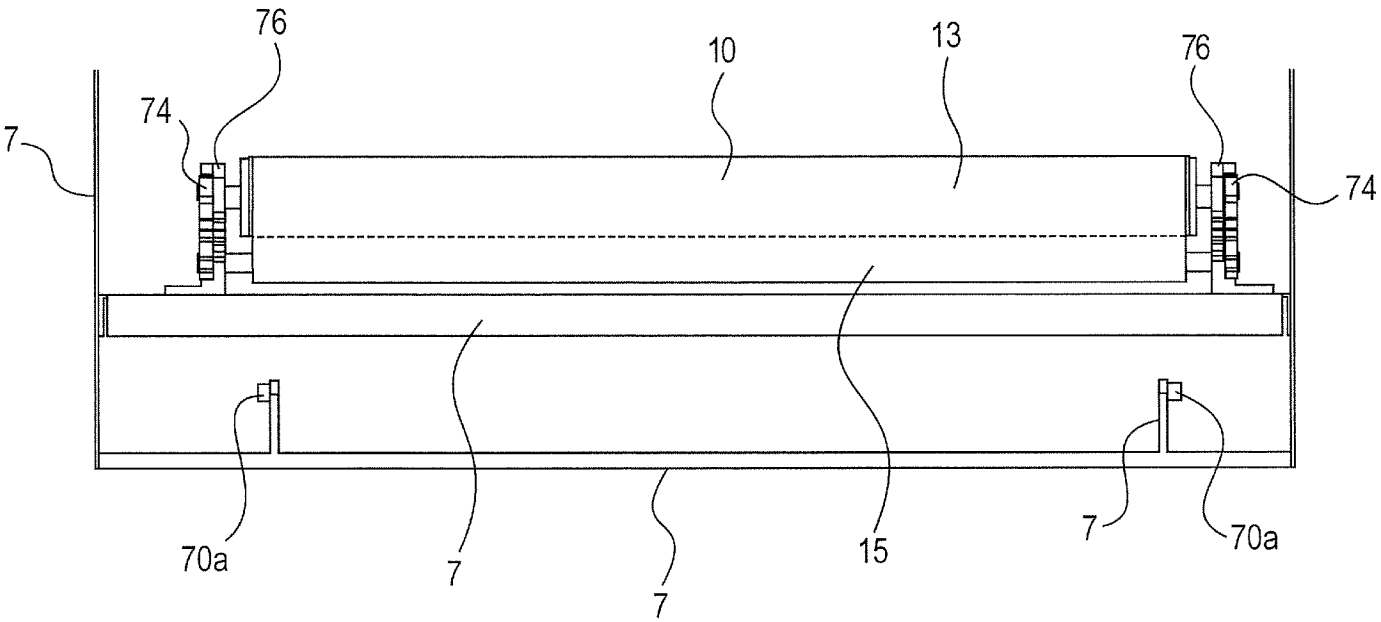
FIG. 2 is an illustrative front view describing a configuration in which an image bearing member is held by a main body unit.
Figure 3:
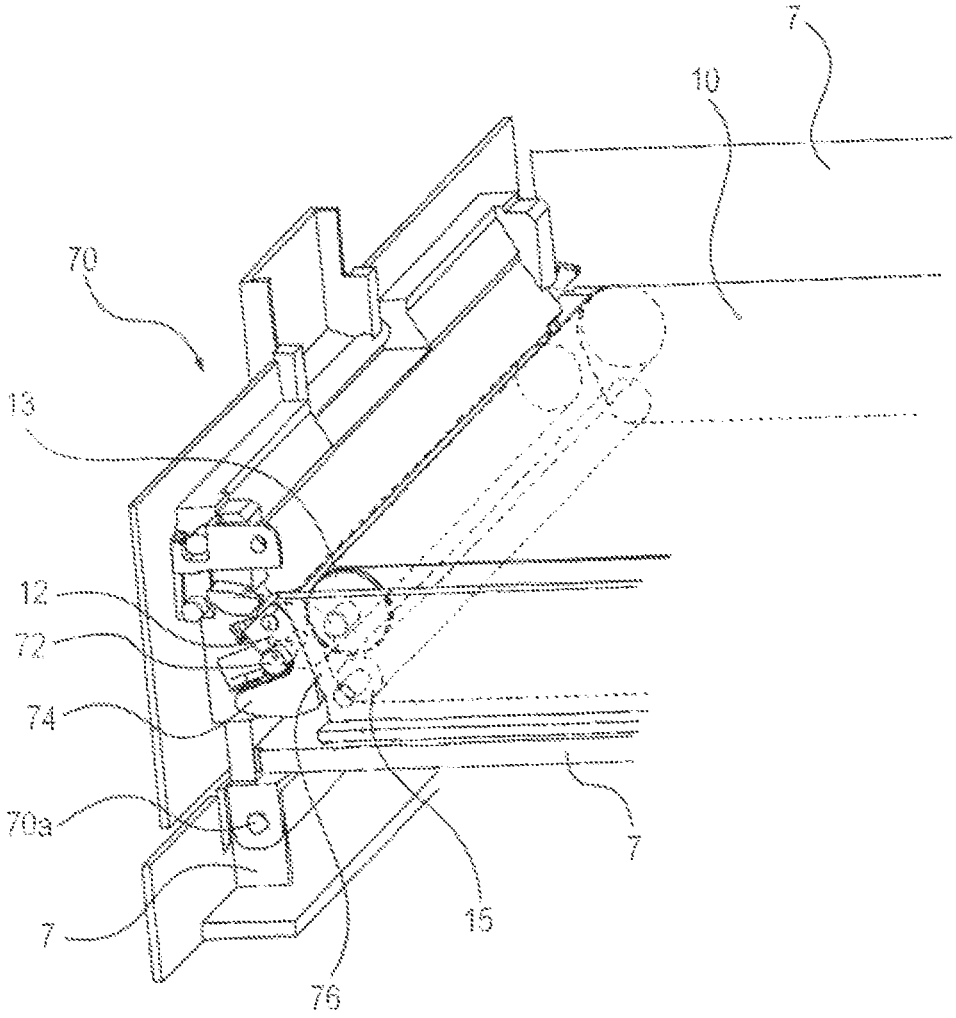
FIG. 3 is an illustrative perspective view describing the relationship between a secondary transfer unit and the main body unit.
Figure 4:
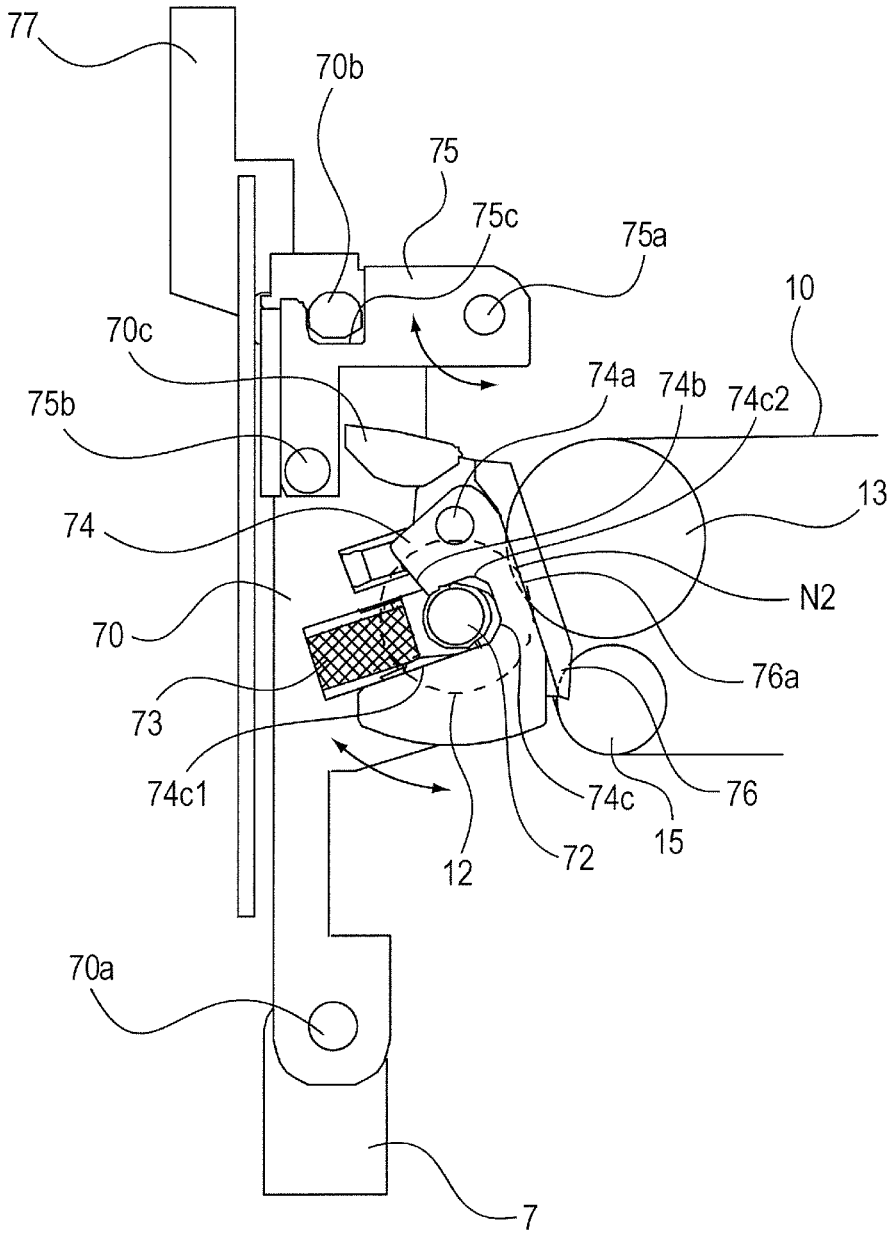
FIG. 4 is an illustrative cross-sectional view describing a configuration of major components of the image forming apparatus according to the present invention, with the secondary transfer unit being closed with respect to the main body unit.

FIG. 2 is an illustrative front view describing a configuration in which the intermediate transfer belt 10 is held by a main body unit 7. FIG. 3 is an illustrative perspective view describing the relationship between a secondary transfer unit 70 and the main body unit 7. FIG. 4 is an illustrative cross-sectional view describing a configuration of major components of the image forming apparatus according to the present invention, with the secondary transfer unit 70 being closed with respect to the main body unit 7. Features of the present embodiment will be described below with reference to FIGS. 2 to 8.

FIG. 4 is a view describing a locked state of the secondary transfer unit 70 including the secondary transfer roller 12 and conveyance guides provided on the upstream and downstream sides of the secondary transfer roller 12 in the sheet conveying direction in the image forming apparatus 100.

In particular, the secondary transfer unit 70 is a secondary transfer unit for transferring to the recording material 6 in the secondary transfer process a toner image which has been transferred from the photoconductive drum 1 to the intermediate transfer belt 10 in the primary transfer process.

As shown in FIG. 3, the secondary transfer unit 70 is provided so as to be openable and closable with respect to the main body unit 7 of the apparatus by rotating around a pivot axis 70*a*. A toner image formed on the outer surface of the intermediate transfer belt 10 is transferred to the recording material 6 with the recording material 6 being held between the intermediate transfer belt 10 and the secondary transfer roller 12 provided so as to be rotatable in the secondary transfer unit 70.

The secondary transfer unit 70 according to the present embodiment is configured to be openable and closable with respect to the main body unit 7 of the apparatus around the open-close fulcrum, pivot axis 70*a*, wherein the open-close fulcrum is the first pivot hereinafter referred in this specification. Meanwhile, a locking member 75 is provided so as to be rotatable around a pivot point 75*a* in the main body unit 7 of the apparatus. A boss 70*b* provided on the secondary transfer unit 70 is fit in an engagement groove 75*c* of the locking member 75 provided so as to be rotatable around the pivot point 75*a* arranged in the main body unit 7 of the apparatus, whereby the secondary transfer unit 70 is held in the closed state.

The locking member 75 is configured to be rotatable around the pivot point 75*a* downward from the locking position shown in FIG. 4, and urged by an urging unit, e.g., a spring, which is not shown in the drawings, around the pivot point 75*a* in the clockwise direction in FIG. 4.

The secondary transfer roller 12 is urged by an urging unit, secondary transfer spring 73, toward the intermediate transfer belt 10 wound around the driving roller 13, and thus contacts the intermediate transfer belt to form the secondary transfer nip portion N2. The secondary transfer spring 73 is provided on the secondary transfer unit 70.

The urging unit, secondary transfer spring 73, urges a bearing member 72 which serves as a transferring-side engagement portion for rotatably supporting the secondary transfer roller 12 in such a direction as to enable the secondary transfer roller 12 of the secondary transfer unit 70 and the intermediate transfer belt 10 to hold the recording material 6 between them.

The bearing member 72, which serves as a transferring-side engagement portion, is provided to the secondary transfer unit 70, and engages with an engagement groove 74*c* of a hooking-receiving member 74, which serves as an opposing member, provided so as to be rotatable around a pivot point 74*a* in the main body unit 7 of the apparatus, wherein the pivot point 74*a* is the second pivot hereinafter referred in this specification. (Hereinafter, the transferring-side engagement portion may be referred to as the first engagement portion and the engagement groove may be referred to as the second engagement portion.) The engagement groove 74*c* is formed in the shape of the letter "J." The hooking-receiving member 74 is placed in a position opposite the bearing member 72. The "J" shape of the engagement groove 74*c* has a guide portion 74*c*1 for guiding the bearing member 72 and a holding portion 74*c*2 for holding the bearing member 72.

Reaction force exerted on the secondary transfer roller 12 which forms the secondary transfer nip portion N2 is received by the pivot axis 70*a* via the secondary transfer unit 70 and by the locking member 75.

The hooking-receiving member 74 is mounted so as to be rotatable around the second pivot 74*a* provided in the main body unit 7 of the apparatus. The hooking-receiving member 74 is held in such a manner that the hooking-receiving member 74, due to its own weight, contacts an contact surface 76*a* of a rotation regulation member 76 provided to the main body unit 7 of the apparatus and the rotation of the hooking-receiving member 74 is regulated by the contact surface 76*a*.

Furthermore, the bearing member 72 which holds each end of the secondary transfer roller 12, and the engagement groove 74*c* of the hooking-receiving member 74 have a predetermined clearance. Accordingly, even if the position of the driving roller 13 or the position of the secondary transfer roller 12 changes because of poor accuracy or distortion of parts of them, the secondary transfer process is not affected by those changes.

Actions of the hooking-receiving member 74 at the time of closing the secondary transfer unit 70 will be described next with reference to FIG. 5 and FIG. 6.

The bearing member 72 is configured so as to contact a contact surface 74*b* of the hooking-receiving member 74 on a path of rotation of the bearing member 72 when the secondary transfer unit 70 is closed by rotating it around the pivot axis 70*a*. FIG. 5 shows that the bearing member 72 contacts the contact surface 74*b* of the hooking-receiving member 74 and the hooking-receiving member 74 contacts the contact surface 76*a* of the rotation regulation member 76 when the secondary transfer unit 70 is closed with respect to the main body unit 7 of the apparatus.

The locking member 75 is provided so as to be rotatable around the pivot point 75*a* arranged in the main body unit 7 of the apparatus. A boss 75*b* is provided so as to protrude from the end portion of the locking member 75. Meanwhile, a cam 70*c* is provided to the secondary transfer unit 70 in a position corresponding to the boss 75*b*. The boss 75*b* contacts and slides along a cam surface 70*c*1 of the cam 70*c* moving integrally with the secondary transfer unit 70 when the secondary transfer unit 70 is closed by rotating it around the pivot axis 70*a*. As a result, the boss 75*b* provided on the locking member 75 is pushed downward. In this manner, the locking member 75 is pushed downward in the direction of the arrow "d" in FIG. 5 around the pivot point 75*a* against urging force exerted by an urging unit not shown in the drawings.

Figure 5:
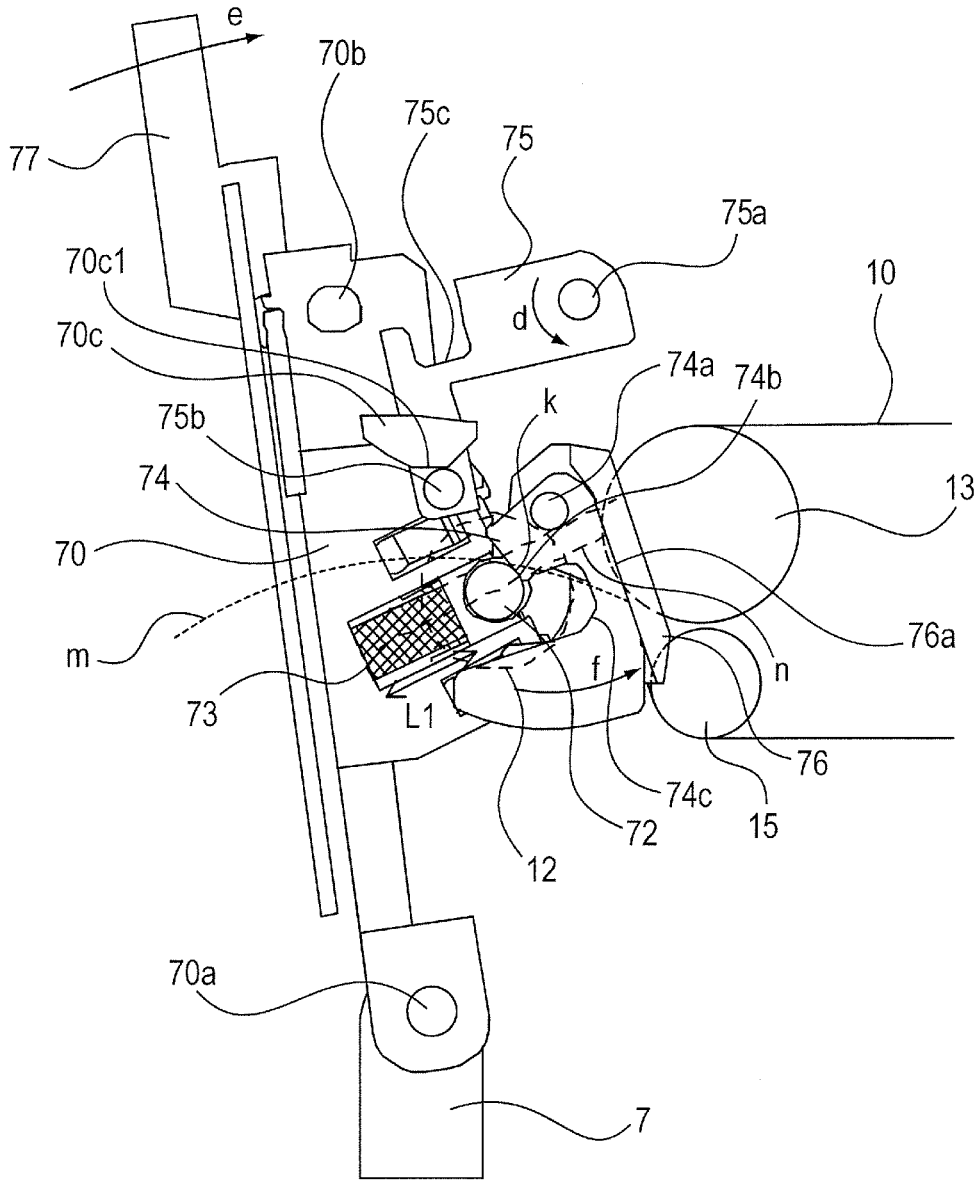
FIG. 5 is an illustrative cross-sectional view describing states of respective components of the image forming apparatus according to the present invention in a contacting position where a transferring-side engagement portion contacts an opposing member during the process of closing the secondary transfer unit with respect to the main body unit.

As shown in FIG. 5, the bearing member 72 contacts the contact surface 74*b* of the hooking-receiving member 74. In this state, the second pivot 74*a* of the hooking-receiving member 74 is outside a circle "m" (circular arc) centered at the pivot axis 70*a* of the secondary transfer unit 70 and passing through a contacting position "k".

In addition, the contacting position "k" where the bearing member 72 contacts the contact surface 74*b* of the hooking-receiving member 74 is arranged on the same side of a line "n" extending in the direction along which the bearing member 72 is urged by the secondary transfer spring 73 as the second pivot 74*a* of the hooking-receiving member (this side is hereinafter referred to as the pivot point side).

In other words, when the bearing member 72 contacts the contact surface 74*b* of the hooking-receiving member 74, the second pivot 74*a* of the hooking-receiving member 74 is positioned above the contacting position "k" in FIG. 5. The second pivot 74*a* is positioned above the path of rotation of the bearing member 72 centered at the pivot axis 70*a* of the secondary transfer unit 70 and passing through the contacting position "k" in FIG. 5. The second pivot 74*a* is positioned above the line "n" extending in the direction of urging the bearing member 72 by the secondary transfer spring 73 in FIG. 5.

This configuration allows the secondary transfer unit 70 to be further rotated around the pivot axis 70*a* in the direction of the arrow "e" in FIG. 5, i.e., closing direction, from the position shown in FIG. 5. As a result, the contact surface 74*b* below the second pivot 74*a* of the hooking-receiving member 74 in FIG. 5 is pushed by the bearing member 72, which induces moment of rotation acting on the hooking-receiving member 74 in the direction of the arrow "f" in FIG. 5 around the second pivot 74*a*. Then, the hooking-receiving member 74 contacts the contact surface 76*a* of the rotation regulation member 76 and the rotation of the hooking-receiving member 74 is regulated by the contact surface 76*a*, and thus the urging force of the secondary transfer spring 73 is received by the contact surface 76*a* of the rotation regulation member 76, thereby holding the hooking-receiving member 74.

Figure 6:
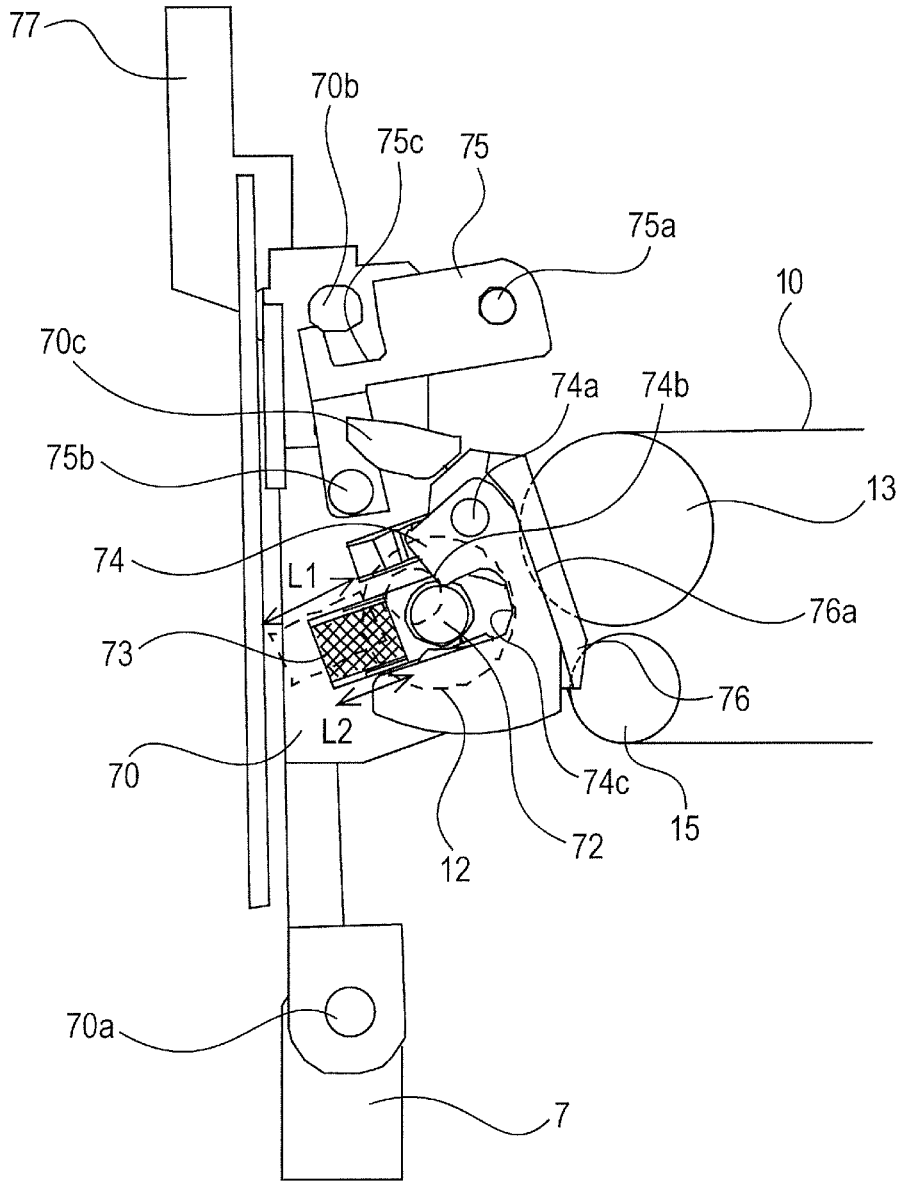
FIG. 6 is an illustrative cross-sectional view describing a state of the image forming apparatus according to the present invention where the transferring-side engagement portion pushes and rotates the opposing member to move the opposing member away from the contacting position during the process of closing the secondary transfer unit with respect to the main body unit.

When the secondary transfer unit 70 is further moved in its closing direction, the secondary transfer spring 73 is compressed and its spring length decreases from L1 to L2, as shown in FIG. 6. Then, the bearing member 72 moves downward in FIG. 6 along the contact surface 74*b* from the contacting position "k" shown in FIG. 5 with the bearing member 72 contacting the contact surface 74*b* of the hooking-receiving member 74.

At this point, the distance between the pivot axis 70*a* of the secondary transfer unit 70 and the bearing member 72 decreases as the spring length of the secondary transfer spring 73 become shorter.

FIG. 6 shows the positions of the bearing member 72 immediately before the bearing member 72 moves beyond the contact surface 74*b* of the hooking-receiving member 74. At this point, the secondary transfer spring 73 is compressed and its spring length decreases from L1 to L2.

When the bearing member 72 moves beyond the contact surface 74*b* of the hooking-receiving member 74, the secondary transfer spring 73 expands and its length increases from L2 to L1 with its one end on the secondary transfer unit 70 side being fixed with respect to the secondary transfer unit 70. Accordingly, the secondary transfer roller 12 and the bearing member 72 at each end of the secondary transfer roller 12 move in a direction toward the driving roller 13 which serves as a secondary transfer opposing roller, i.e., the closing direction of the secondary transfer unit 70.

In practice, a difference between the spring lengths L1 and L2 of the compressed secondary transfer spring 73 tends to be smaller than a designed nominal value. This is because parts around the secondary transfer spring 73 having high spring force are not completely rigid bodies and elastically deform.

After the bearing member 72 moves beyond the contact surface 74*b* of the hooking-receiving member 74, restoring force caused by those elastic deformations combines with the force exerted on the secondary transfer roller 12 and the bearing member 72 on each side of the secondary transfer roller 12 in the closing direction of the secondary transfer unit 70.

Figure 8:
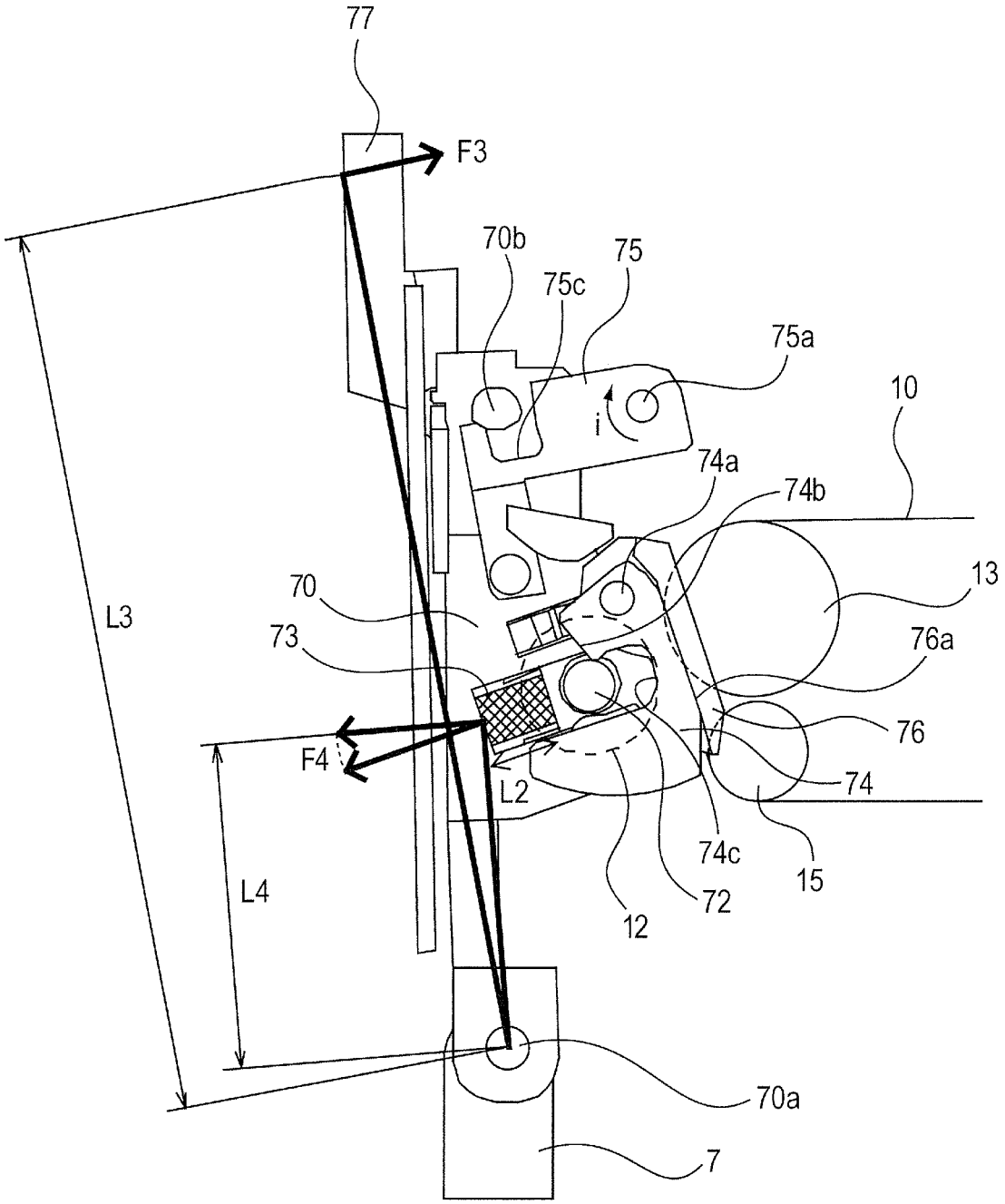
FIG. 8 is a view describing force exerted in the direction of closing the secondary transfer unit with respect to the main body unit in the image forming apparatus according to the present invention.

FIG. 8 is a view describing force exerted in the direction of closing the secondary transfer unit 70 with respect to the main body unit 7 of the apparatus in the image forming apparatus 100. As shown in FIG. 8, reaction force caused by the secondary transfer spring 73 in a position where the spring length of the secondary transfer spring 73 is L2 is exerted on the secondary transfer unit 70. A user produces moment of rotation (length L3×force F3) in the closing direction via some parts which moment is equal to or greater than moment of rotation (length L4×force F4) produced by the reaction force around the pivot axis 70*a*.

This force (moment) is equal to or greater than the force (moment) required when the secondary transfer unit 70 is in the locked state because the secondary transfer spring 73 is compressed and its spring length decreases from L1 to L2. In other words, L3×F3 is equal to or greater than L4×F4.

By this force (moment), after the bearing member 72 moves beyond the contact surface 74*b* of the hooking-receiving member 74, the secondary transfer unit 70 is pulled to the locking position.

When the locking member 75 is pushed downward by the boss 70*b* and the boss 70*b* reaches the engagement groove 75*c*, the locking member 75 is urged by an urging unit not shown in the drawings to rotate in the direction of the arrow "i" in FIG. 8 around the pivot point 75*a*. Then, the boss 70*b* is fit in the engagement groove 74*c* of the locking member 75, and thus the rotation of the secondary transfer unit 70 is stopped. At this point, the secondary transfer unit 70 is locked by the locking member 75 by way of the urging force of the secondary transfer spring 73.

Actions of the hooking-receiving member 74 and components around the hooking-receiving member 74 at the time of opening the secondary transfer unit 70 shown in FIG. 7 from its locked state shown in FIG. 4 will be described next.

Figure 7:
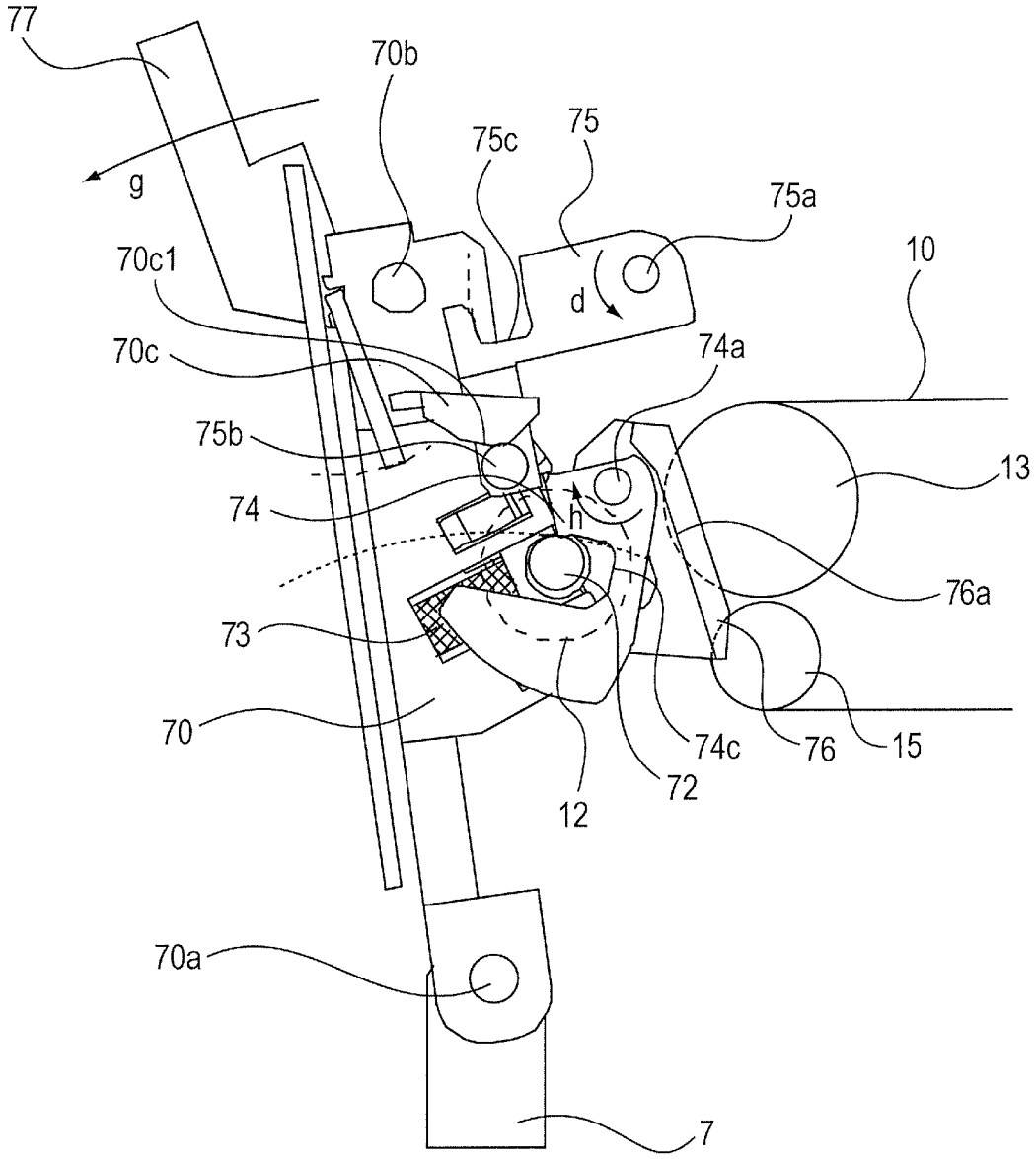
FIG. 7 is an illustrative cross-sectional view describing actions of respective components of the image forming apparatus according to the present invention when the secondary transfer unit is opened with respect to the main body unit.

A lever 77 is moved in the direction of the arrow "g" in FIG. 7 to open the secondary transfer unit 70 by a user or other parts not shown in the drawings. Accordingly, the locking member 75 is rotated in the direction of the arrow "d" in FIG. 7 around the pivot point 75*a* from the locking position shown in FIG. 4 to separate the boss 70*b* provided on the secondary transfer unit 70 from the engagement groove 75*c* of the locking member 75, thereby unlocking the secondary transfer unit 70.

When the secondary transfer unit 70 is unlocked from the locking member 75, the secondary transfer unit 70 rotates and opens in the direction of the arrow "g" in FIG. 7 around the pivot axis 70*a*. In doing so, the bearing member 72 contacts the upper surface of the engagement groove 74*c* of the hooking-receiving member 74 on the path of rotation of the bearing member 72 around the pivot axis 70*a*. After the bearing member 72 contacts the upper surface of the engagement groove 74*c* of the hooking-receiving member 74, the hooking-receiving member 74 is rotated in the direction of the arrow "h" in FIG. 7 around the second pivot 74*a* in synchronization with the action of the bearing member 72, and thus the hooking-receiving member 74 does not interfere with opening of the secondary transfer unit 70.

At this point, as the secondary transfer unit 70 is opened with respect to the main body unit 7 of the apparatus, the hooking-receiving member 74 rotates in the direction of the arrow "h" in FIG. 7 around the second pivot 74*a* and separates from the rotation regulation member 76. When the secondary transfer unit 70 is opened and the bearing member 72 is separated from the hooking-receiving member 74, the hooking-receiving member 74, due to its own weight, rotates around the second pivot 74*a* and returns to the locked state shown in FIG. 4.

The secondary transfer unit 70 is rotated in the direction of the arrow "e" in FIG. 5 around the pivot axis 70*a* from the open position where the secondary transfer unit 70 is opened with respect to the main body unit 7 of the apparatus as shown in FIG. 7. In the end, the secondary transfer unit 70 is moved to an engaging position where the secondary transfer unit 70 is closed with respect to the main body unit 7 of the apparatus as shown in FIG. 4.

In doing so, as shown in FIG. 5, the bearing member 72 urged by the secondary transfer spring 73 contacts the contact surface 74*b* of the hooking-receiving member 74 and then rotates the hooking-receiving member 74 in the direction of the arrow "f" in FIG. 5 around the second pivot 74*a*. Subsequently, as shown in FIG. 6, the bearing member 72 moves beyond the contact surface 74*b* of the hooking-receiving member 74, and the hooking-receiving member 74 moves out of the way of the bearing member 72.

In addition, the hooking-receiving member 74, which is provided so as to be rotatable around the second pivot 74*a*, is configured to move in synchronization with the rotation of the bearing member 72 around the pivot axis 70*a* when the secondary transfer unit 70 is opened. This may reduce incomplete locking of the locking portion of the openable and closable secondary transfer unit 70 with a low-cost and small (space-saving) configuration.

The secondary transfer unit 70 can be moved with lesser force when it is opened. Furthermore, excessive open-close operation by a user due to incomplete locking can be reduced.

In the present embodiment, the pivot axis 70*a* of the secondary transfer unit 70 is configured so as to be rotatably supported in a circular hole, and the rotation of the secondary transfer unit 70 is stopped by engagement of the boss 70*b* with the engagement groove 75*c* of the locking member 75. However, the pivot axis 70*a* may be configured so as to be rotatably supported in an elongated hole provided in the horizontal direction, for example, and the position of the secondary transfer unit 70 may be adjusted in one direction along the elongated hole, while the position in the height direction can be adjusted at a different portion.

The present invention is not limited to the open-close mechanism of the secondary transfer unit 70. For example, the present invention can be implemented in a configuration in which, instead of the secondary transfer roller 12, the primary transfer roller 11 shown in FIG. 1 serving as a transfer unit can associate with and dissociate from the main body unit which holds the photoconductive drum 1 serving as an image bearing member.

In the present embodiment, the secondary transfer unit 70 is configured so as to move integrally with an openable and closable cover which is an openable and closable portion of the exterior of main body of the image forming apparatus 100 (main body of image forming apparatus). In other embodiments, the secondary transfer unit 70 may be configured so as to move in synchronization with an openable and closable portion of the exterior of main body of the image forming apparatus 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-091700, filed Apr. 13, 2012, which is hereby incorporated by reference herein in its entirety.

What is claimed is:

1. An image forming apparatus comprising:

an image bearing member, on a surface of which a toner image is formed;

a main body unit configured to support the image bearing member;

a transfer unit provided so as to be openable and closable with respect to the main body unit, the transfer unit being configured to hold a recording material between the transfer unit and the image bearing member and transfer a toner image formed on the image bearing member to the recording material;

a first engagement portion provided to the transfer unit, the first engagement portion configured to engage with the main body unit;

an opposing member movable and opposed to the first engagement portion; and a regulation member provided to the main body unit, the regulation member configured to regulate movement of the opposing member, wherein the opposing member contacts the regulation member when the transfer unit is closed with respect to the main body unit, and the opposing member moves away from the regulation member when the transfer unit is opened with respect to the main body unit.

2. An image forming apparatus according to claim 1, wherein the first engagement portion is rotatable with respect to the main body unit.

3. An image forming apparatus according to claim 1, wherein the opposing member comprises a second engagement portion configured to engage with the first engagement portion.

4. An image forming apparatus according to claim 2, wherein the image forming apparatus comprises an urging member configured to urge the first engagement portion in a direction in which the transfer unit holds the recording material between the transfer unit and the image bearing member, and wherein when the transfer unit is moved from an open position where the transfer unit is opened with respect to the main body unit to an engaging position where the transfer unit is closed with respect to the main body unit, the first engagement portion urged by the urging member contacts the opposing member and then rotates the opposing member to move the opposing member away from the first engagement portion.

5. An image forming apparatus according to claim 4, wherein the transfer unit is configured to be openable and closable with respect to the main body unit around a first pivot, wherein the opposing member is pivotable around a second pivot, and wherein when the first engagement portion contacts the opposing member, the second pivot is outside a circle centered at the first pivot and passing through a contacting position where the first engagement portion contacts the opposing member, and the contacting position where the first engagement portion contacts the opposing member is arranged on the same side of a line extending in a direction of urging the first engagement portion by the urging member as the second pivot.

6. An image forming apparatus according to claim 1, wherein the transfer unit moves together with an openable and closable member which is a portion of an exterior of a main body of the image forming apparatus.

7. An image forming apparatus according to claim 1, wherein the transfer unit moves in association with an openable and closable portion of an exterior of a main body of the image forming apparatus.

8. An image forming apparatus according to claim 1, wherein the transfer unit is a secondary transfer unit which transfers a toner image to a recording material in a secondary transfer process after the toner image is transferred to the image bearing member in a primary transfer process.

9. An image forming apparatus according to claim 3, wherein the second engagement portion is a groove in a shape having a guide portion for guiding the first engagement portion and a holding portion for holding the first engagement portion.

10. An image forming apparatus according to claim 1, wherein the transfer unit includes a locking member configured to lock the transfer unit with respect to the main body unit.

* * * * *